United States Patent [19]

Young et al.

[11] 4,251,787

[45] Feb. 17, 1981

[54] ADJUSTABLE COUPLING CAVITY FILTER

[75] Inventors: Frederick A. Young, Huntington Beach; Charles F. Montgomery, Paradise, both of Calif.

[73] Assignee: Hughes Aircraft Company, Culver City, Calif.

[21] Appl. No.: 21,645

[22] Filed: Mar. 19, 1979

[51] Int. Cl.[3] ..... H01P 1/20

[52] U.S. Cl. ..... 333/209; 333/212

[58] Field of Search ..... 333/209, 212, 230, 231, 333/232

[56] References Cited

U.S. PATENT DOCUMENTS 3,544,927 12/1970 Elder et al. ..... 333/209

4,028,651 6/1977 Leetmaa ..... 333/212

*Primary Examiner*—Eugene R. LaRoche

*Attorney, Agent, or Firm*—John Holtrichter, Jr.; W. H. MacAllister

[57] ABSTRACT

There is herein described a microwave coupled-cavity filter having adjacent cavities defined by spaced end walls disposed in a tubular side wall, the end walls including at least one pair of oppositely disposed coupling apertures extending radially from the side wall toward the center of the associated end wall, and at least one of the associated pair of the coupling apertures containing a tuning screw extending through the side wall for precisely adjusting the coupling between adjacent filter cavities.

7 Claims, 4 Drawing Figures

ADJUSTABLE COUPLING CAVITY FILTER

BACKGROUND OF THE INVENTION

The background of the invention will be set forth in two parts.

FIELD OF THE INVENTION

This invention relates generally to the field of microwave filters and more particularly to coupled tunable cavity filters.

DESCRIPTION OF THE PRIOR ART

In microwave filters with exact performance requirements, it is desirable to employ tuning adjustments to alleviate the need for unreasonable fabrication tolerances. In broad band, low-Q, waveguide filters the coupling between adjacent filter cavities is accomplished through coupling apertures located in the center of the cavity end walls or iris plates. These apertures located are normally in the form of a round hole slot or a cross slot, and the coupling is made adjustable by tuning screws extending through a threaded bore in the plane of the relatively thick end wall and extending into the slot or coupling aperture. An example of this type of filter is found in U.S. Pat. No. 3,544,927.

On the other hand, in high Q cavity filters having relatively thin end walls provided with circular, slot or cross-slot coupling apertures, the end wall or iris plate thickness is much less than the diameter of the tuning screw, which makes the use of such screws impractical.

In the past, the coupling in high Q cavity filters was adjusted by reaming or machining the irises, which is an expensive and time-consuming task. In fact, this scheme is not practical with filters fabricated from Invar since this material must be silver plated before electrical tests can be made. The plating must next be removed before any modification can be made, and the filter structure must then be replated before retesting.

In order to overcome the problem of seating the tuning screw in the end walls, some prior art structures provide a bushing in the end walls, the latter containing a centered coupling aperture. The bushing forms a threaded seat for the tuning screw and thus overcomes the problem of properly seating the screw. However, this solution has the drawback of degrading the Q of the cavities in which it resides because of the bushing's relatively large size. This type of microwave structure is represented by the device described in U.S. Pat. No. 2,524,268.

In accordance with still another prior art technique designed to achieve a relatively high-Q tuned coupled-cavity filter, there is provided in the center of each relatively thin end wall a relatively large nonadjustable coupling aperture. Also provided in this scheme, is a relatively smaller secondary tuning aperture located near the outer edge of the end wall separating the adjacent cavities. Each secondary tuning aperture contains a tuning screw extending through the side wall of the filter to allow the coupling to be adjusted between each cavity. This particular advancement in the art is described in U.S. Pat. No. 4,028,651.

SUMMARY OF THE INVENTION

In view of the foregoing factors and conditions characteristic of the prior art, it is a primary object of the present invention to provide an improved coupled-cavity microwave filter having adjustable coupling means.

Another object of the present invention is to provide an adjustable coupling cavity microwave filter exhibiting relatively high Q.

Still another object of the present invention is to provide a tunable microwave coupled-cavity filter in either a cylindrical or rectangular waveguide structure.

Yet another object of the present invention is to provide an adjustable coupling cavity filter especially adaptable to dual mode, bridge coupled filter designs.

Still a further object of the present invention is to provide an adjustable coupling cavity filter wherein at least one tuning screw is used in conjunction with a balanced edge coupled iris.

In accordance with one embodiment of the invention, an adjustable coupling cavity filter includes a plurality of tandemly disposed, relatively high Q filter cavities, each defined by spaced planar end walls disposed in and orthogonally oriented with respect to the longitudinal axis of a tubular side wall. The invention also includes coupling means with at least one pair of oppositely disposed coupling apertures in those of the end walls separating the cavity filters, the coupling apertures extending radially from the side wall toward the center of the associated one of the end walls. At least one of the coupling apertures contains a tuning screw extending through the side wall for precisely adjusting the coupling between adjacent ones of the cavities.

The side wall of the filter may have either a circular or rectangular cross section, and the end walls therein will conform to the shape and dimensions within the side wall.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawing in which like reference characters refer to like elements in the several views.

DESCRIPTION OF THE PREFERRED EMBODIMENTS

Figure 1:
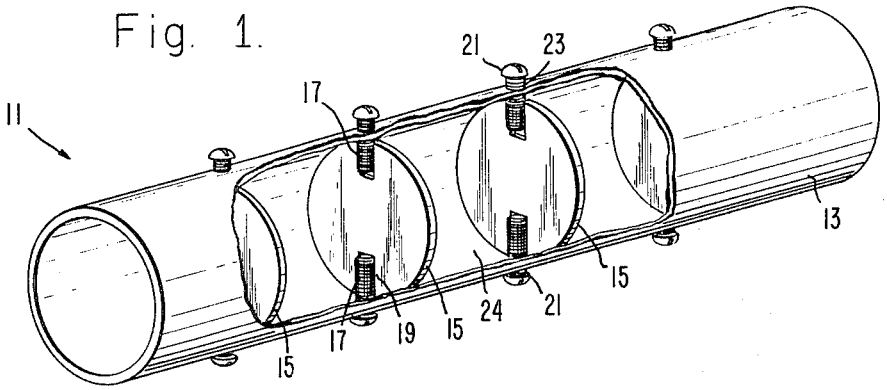
FIG. 1 is a perspective view of an adjustable coupling microwave cavity filter having a plurality of cascaded high Q cavities defined by end walls incorporating balanced edge coupled aperture configurations.

Referring now to the drawing and more particularly to FIG. 1, there is shown an adjustable coupling microwave coupled-cavity filter 11 having a cylindrical side wall 13 and a plurality of spaced irises or end walls 15 oriented orthogonally with respect to the longitudinal axis of the side wall. Each of the end walls 15, in this embodiment, is provided with a pair of oppositely disposed coupling apertures 17 having threaded side edges 19 adapted to threadably engage a tuning screw 21 that extends through appropriate holes 23 in the side wall 13.

Thus, it can be seen that the new coupling geometry, which may be referred to as a balanced edge coupling design, has a pair of coupling apertures 180 degrees apart extending radially from the outer edges of the end walls toward the center of a cavity 23 defined by the end walls 15 and the side wall 13. This configuration very easily permits the use of one or more tuning screws to be implemented.

It should readily be seen that the inventive design overcomes the problems in prior art designs where it is mechanically difficult to implement a tuning screw when the coupling aperture is located in the center of the cavity end wall, because the iris thickness is much thinner than the diameter of a tuning screw. Again, this has required extreme machining tolerances required of filter utilizing nonadjustable iris geometries. The balanced edge coupled aperture design is also less sensitive to machining tolerances because the apertures are not located in the maximum field area.

Figure 2:
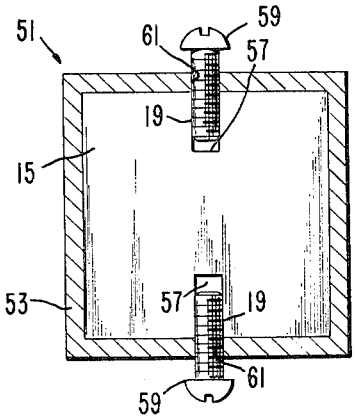
FIG. 2 is an enlarged cross sectional view of the cavity filter showing an end wall in accordance with another embodiment of the invention.

Referring now to FIG. 2, this embodiment of the invention, herein identified by reference numeral 51, like that of FIG. 1, is a Tchebyscheff filter design, but the side wall 53 configuration of FIG. 2, is rectangular. Accordingly, this iris or end wall 55 has a rectangular shape to conform to the inner surface of the side wall. The oppositely disposed coupling apertures 57 and associated tuning screws 59, extending through holes 61 in the side wall, are similar in design and function to the coupling apertures and tuning screws of the device illustrated in FIG. 1. Accordingly, no detailed description will be given.

Figure 3:
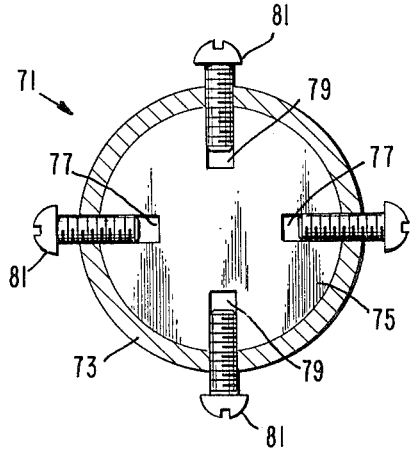
FIG. 3 is a cross sectional view of a microwave cavity filter in accordance with still another embodiment of the present invention.
Figure 4:
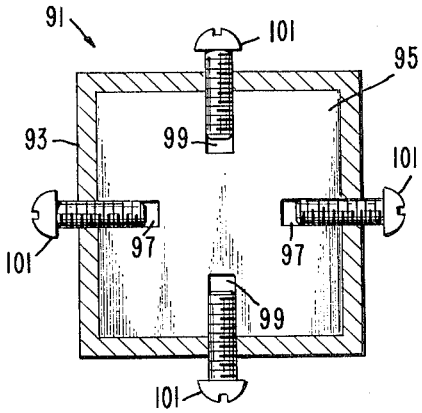
FIG. 4 is a dual mode filter having a rectangular cross-section, in accordance with still another embodiment of the invention.

The coupling scheme in accordance with the invention is especially adapted to dual mode, bridge coupled filter designs, as shown in FIGS. 3 and 4, because the interaction between bridge and main coupling is less than the standard cross slot design.

FIG. 13 illustrates an elliptic function dual mode filter 71 having a cylindrical side wall configuration 73 and cavity-defining irises or end walls 75 with oppositely extending and orthorgonally disposed pairs of coupling slots 77 and 79, and tuning screws 81, respectively. Likewise, a dual mode filter 91 is shown in FIG. 4 having a rectangular side wall 93, end walls 95, slots 97 and 99, and tuning screws 101.

From the foregoing it should be evident that there has herein been disclosed a simple yet highly efficient and effective, highly coupled-cavity microwave filter design with adjustable tuning of the inter-cavity coupling to compensate for fabrication tolerances and inherent inaccuracies in theoretical filter designs.

It should be understood that the materials used in fabricating the various embodiments of the invention are not critical and any material generally found suitable for microwave filter designs may be utilized. Further, it should be recognized that although a limited number of embodiments haved been described in detail, nevertheless, various changes and modifications which are obvious to persons skilled in the art to which the invention pertains are deemed to lie within the spirit, scope and contemplation of the invention.

What is claimed is:

1. An adjustable coupling microwave cavity filter, comprising:

a plurality of tandemly disposed, relatively high Q filter cavities each defined by spaced planar end walls disposed in a tubular side wall and orthogonally oriented with respect to the longitudinal axis of the side wall;

coupling means including at least one pair of oppositely-disposed coupling apertures in those of said end walls separating said cavity filters, said coupling apertures extending radially inwardly from the outer edge of said end walls, said coupling means also including at least one tuning screw movably extending through an appropriate hole in said side wall and into an associated coupling aperture for precisely adjusting the coupling between adjacent ones of said filter cavities.

2. An adjustable coupling microwave cavity filter according to claim 1, wherein the longitudinal inner edges of said coupling apertures are threaded to threadably engage one of said tuning screws.

3. An adjustable coupling microwave cavity filter according to claim 1, wherein the diameter of the threaded portion of said tuning screws is relatively larger than the thickness dimension of said end walls.

4. An adjustable coupling microwave cavity filter according to claim 1, wherein said side wall has a circular cross section and said outer edge of said end walls conform to the shape and dimensions of the inner surface of said side wall.

5. An adjustable coupling microwave cavity filter according to claim 1, wherein said coupling means includes a first pair of oppositely disposed coupling apertures.

6. An adjustable coupling microwave cavity filter according to claim 5, wherein said coupling means also includes a second pair of oppositely disposed coupling apertures, the axes of said first and second pairs of coupling apertures being orthogonal to each other.

7. An adjustable coupling microwave cavity filter according to claim 1, wherein said side wall has a square cross section and said outer edge of said end walls conform to the shape and dimensions of the inner surface of said side wall.

* * * * *